United States Patent [19]

Takeda et al.

[11] Patent Number: 4,842,253

[45] Date of Patent: Jun. 27, 1989

[54] METHOD AND DEVICE FOR MONITORING COMBUSTION IN FURNACE

[75] Inventors: Kanji Takeda; Seiji Taguchi, both of Chiba; Toshikazu Nakai, Tokyo; Haruo Kato, Chiba, all of Japan

[73] Assignee: Kawasaki Steel Corporation, Tokyo, Japan

[21] Appl. No.: 880,898

[22] Filed: Jul. 1, 1986

[30] Foreign Application Priority Data

Jul. 2, 1985 [JP] Japan ..... 60-143942

[51] Int. Cl.[4] ..... C21B 7/24

[52] U.S. Cl. ..... 266/44; 266/99

[58] Field of Search ..... 266/44, 87, 99, 225, 266/81, 78, 265, 266, 269

[56] References Cited

U.S. PATENT DOCUMENTS

| | | | |
|---|---|---|---|
| 2,261,559 | 11/1941 | Osborn | 266/269 |
| 3,210,181 | 10/1965 | Manny | 266/87 |
| 4,353,530 | 10/1982 | Iyama et al. | 266/269 |
| 4,361,315 | 11/1982 | Kajihara et al. | 266/87 |
| 4,619,533 | 10/1986 | Lucas et al. | 266/269 |

FOREIGN PATENT DOCUMENTS

| | | | |
|---|---|---|---|
| 0048007 | 9/1981 | European Pat. Off. . | |
| 675824 | 5/1939 | Fed. Rep. of Germany . | |
| 3008061 | 9/1980 | Fed. Rep. of Germany | 266/87 |
| 1481284 | 5/1967 | France . | |
| 0717139 | 2/1980 | U.S.S.R. | 266/87 |
| 914700 | 1/1963 | United Kingdom . | |
| 2004355 | 3/1979 | United Kingdom . | |

OTHER PUBLICATIONS

Japanese Abstract No. 86 (C-161)(1231), Apr. 9, 1983, vol. 7.

Japanese Abstract No. 181 (C-180)(1326), Aug. 10, 1983, vol. 7.

Japanese Abstract No. 67 (C-216)(1504), Mar. 29, 1984, vol. 8.

*Primary Examiner*—Scott Kastler

*Attorney, Agent, or Firm*—Austin R. Miller

[57] ABSTRACT

A method and a device for monitoring combustion conditions in a metallurgical furnace which is effective and simple in structure and can provide a wide monitoring range of high accuracy. The combustion conditions in the furnace are monitored by a probe lying oblique to the axis of the blow pipe. Toward this end, the probe is inserted into the furnace through a tuyere. The tuyere has a through opening admitting the probe and allows the probe in an orientation oblique to the radii of the blow pipe.

16 Claims, 9 Drawing Sheets

METHOD AND DEVICE FOR MONITORING COMBUSTION IN FURNACE

BACKGROUND OF THE INVENTION

1. Field of the Invention

The present invention relates generally to a method and device for monitoring combustion in a furnace, such as a blast furnace, shaft furnace, reducing furnace or the like. More specifically, the invention relates to a method and device suitable for invention relates to a method and device suitable for monitoring temperature distribution and for sampling gases in a raceway adjoining the tuyere of the furnace.

2. Description of the Prior Art

For many years, there has been desire to monitor the behaviour of molten bodies near the tuyere or melting region in metallurgical furnaces, such as blast furnaces, shaft furnaces, reducing furnaces and so forth, in order to identify the cause of melt-down of the tuyere or formation of pool of molten material in front of the tuyere.

This is especially necessary for effective and efficient control of the composition of molten pig iron. A recently developed technique involves injecting iron ore and pulverized coal into the furnace through the tuyere. The charge injected through the tuyere reacts with the molten pig iron dripping through the coke burden and so changes the composition of the molten pig iron. The composition of the molten pig iron could be controlled only by analysing the mechanism and rate of the reaction between the charge and the molten pig iron. To do this, it would be necessary to measure the temperatures of and to sample the melt and the gas not only in the raceway but also in the central portion of the furnace which is filled with coke.

However, the central portion of the operating furnace is at a very high temperature and is subject to an accordingly large thermal load. This and the presence of the coke burden itself have previously made it difficult to insert a sensor probe into the central portion of the furnace while the furnace is in operation.

In the prior art, there is a raceway probe for monitoring gas composition and gas temperature in the raceway. A raceway probe is disclosed in Japanese Patent First Publication (Tokkai) Showa 58-16005 and the Japanese Utility Model Publication (Jikko) Showa 59-28027. In the aforementioned Japanese Publications, the raceway probe comprises a water-cooled tube inserted into the raceway near the tuyere of the furnace for monitoring gas composition and gas temperature. The probe is inserted into the furnace through a blow pipe and through the tuyere to monitor temperature, gas composition and so forth. The probe must be more than 3 meters long for successful monitoring. The internal diameter of the blow pipe is about 150 mm. Therefore, the orientation of the probe is limited to near that of the axis of the blow pipe, which is essentially radial. This limits the range of monitoring. Furthermore, when the probe is inserted through the blow pipe to monitor combustion conditions, the cross-sectional area of the blow pipe becomes more constricted, which significantly affects combustion.

In order to minimize the adverse affect on the blow pipe cross-section, the external diameter of the probe can be reduced to about 50 mm. However, in that case, the rigidity of the probe would be insufficient to ensure that the tip of the probe reaches the central portion of the furnace. Furthermore, the probe in the blow pipe is subject to very high temperatures, e.g. 1000° C. to 1300° C. Consequently, the probe may sustain approximately half of the total thermal load within the blow pipe. This necessitates a very-large-capacity water-cooling pipe. For instance, when the thermal load is doubled, the water-cooling pipe capacity must also be doubled to handle twice the cooling water.

Furthermore, it cannot be ignored when considering the accuracy of the monitoring that the presence of probe and the monitoring operation themselves will affect combustion conditions.

As can easily be appreciated, the disadvantages of the conventional probe reside in the presence of the probe within the blow pipe. Therefore, most of the disadvantages in the conventional probe can be eliminated if the probe can somehow be inserted into the furnace without passing through the blow pipe.

In this regard, an improved combustion condition monitoring system has been proposed in Japanese Patent Application Showa 59-69217 which has been published under No. 60-213845, and which was filed by the owner of the present invention. The prior proposal made in the foregoing Japanese Patent Application has a rather complicated structure and thus is very expensive.

SUMMARY OF THE INVENTION

Therefore, it is an object of the present invention to provide a method and a device for monitoring combustion conditions in a metallurgical furnace which is effective and simple in structure.

Another object of the invention is to provide a combustion condition monitoring device with a wide monitoring range of high accuracy.

In order to accomplish the aforementioned and other objects, the combustion conditions in the furnace are monitored by a probe lying oblique to the axis of the blow pipe. Toward this end, the probe is inserted into the furnace through a tuyere. The tuyere has a through opening admitting the probe into the interior of the furnace in an orientation oblique to the axis of the blow pipe.

According to one aspect of the invention, a device for monitoring combustion in a furnace comprises a modified tuyere mounted in front of a cooling box of the furnace assembly and defining a through opening extending oblique to a radius of the furnace extending through the center of the tuyere, a probe extending through the through opening into the interior of the furnace across a combustion region for monitoring combustion in the furnace, and a drive mechanism for thrusting the probe into and retracting the probe from the furnace.

Preferably, the obliquity of the through opening in the tuyere allows the probe to extend across a combustion region formed about an adjoining tuyere.

The drive mechanism includes a support for the probe and means for supplying cooling water to the probe. The support comprises a sleeve tube defining therein also a cooling water path and allowing the probe to pass therethrough axially, and a seal pipe sealingly supporting the probe.

The combustion monitoring device may further comprise a retainer for detachably securing the modified tuyere onto the tuyere assembly.

The sleeve tube is in communication with a blow pipe through which air is conducted at a given velocity so as to discharge air into the furnace through the tuyere. The blow pipe is associated with means for restricting displacement of the blow pipe in a direction perpendicular to its axis while permitting axial displacement thereof. The blow pipe is connected to an air source via an air pipe which includes a section allowing axial displacement of the blow pipe.

According to another aspect of the invention, a method for monitoring combustion in a matallurgical furnace comprising the steps of:

defining a passage way for a probe in one tuyere, the axis of which passage way lies oblique to a radius of the furnace passing through the tuyere and extends across a combustion region formed near an adjoining tuyere;

thrustingly inserting the probe through the passage way and across the combustion region toward a central region of the furnace for monitoring.

The method further comprises a step of cooling the probe during insertion and retraction of the probe into and from the furnace.

If required, the method may further comprise a step of blowing air into the furnace through the blow pipe. In the step of blowing air, the air flow into the furnace is sufficient to prevent molten material from flowing back the tuyere.

BRIEF DESCRIPTION OF THE DRAWINGS

The present invention will be understood more fully from the detailed description given herebelow and from the accompanying drawings of the preferred embodiments of the invention, which, however, should not be taken to limit the invention to the specific embodiment, but are for explanation and understanding only.

In the drawings.

DESCRIPTION OF THE PREFERRED EMBODIMENT

Figure 1:
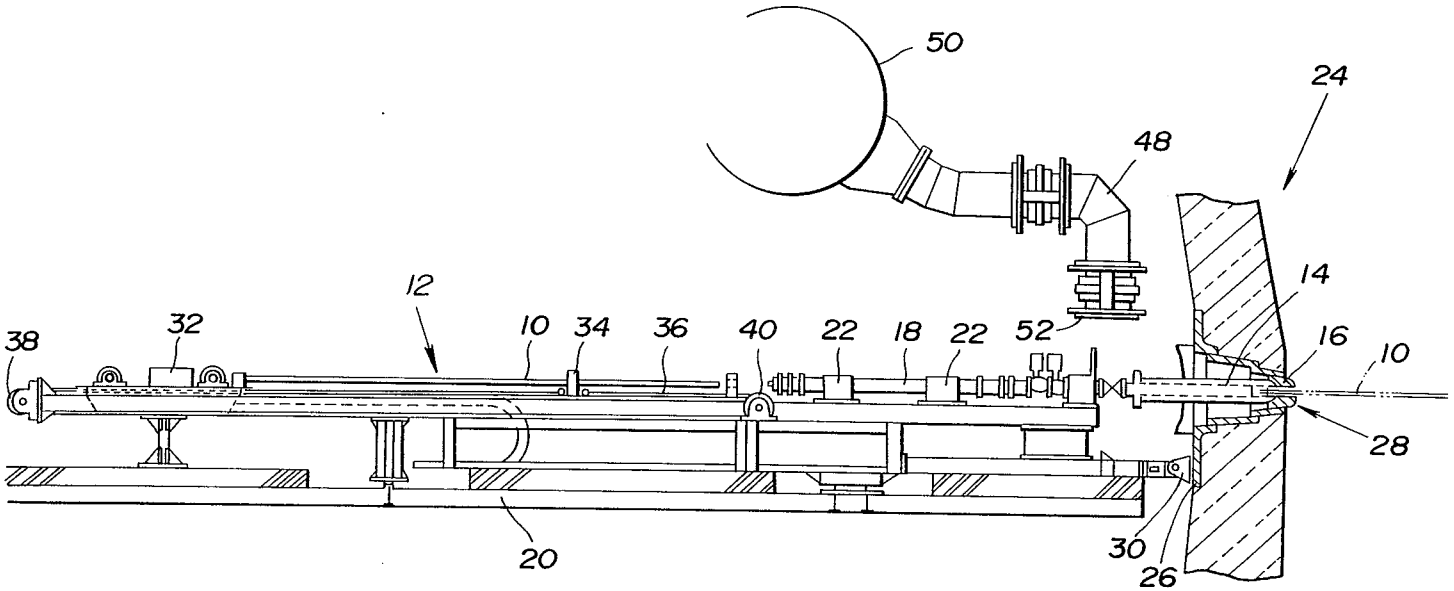
FIG. 1 is a side view of the preferred embodiment of a combustion monitoring device according to the present invention.

Referring now to the drawings, particularly to FIG. 1, the preferred embodiment of a combustion monitoring device according to the present invention generally comprises a probe 10 and a drive 12 for the probe. The probe 10 is supported by a sleeve tube 14 and a modified tuyere 16. The sleeve tube 14 is connected to a seal pipe 18. The seal pipe 18 is mounted on a base frame 20 by means of mounting brackets 22. A force of about 5 to 30 tons is required to insert the probe 10 into the central portion of a furnace 24, such as a blast furnace, a shaft furnace, a reducing furnace or the like. Therefore, the base frame 20 is fixed to a metal frame 26 surrounding a tuyere 28 through a reaction support 30 which bears the reaction to the force of insertion of the probe into the furnace 24.

The probe 10 extends through the sleeve tube 14 and the seal pipe 18 and is connected to a carrier 32 at its outer end. The probe 10 is also supported by another carrier 34 located between the outer end and the end of the seal pipe 18 remote from the furnace. The carriers 32 and 34 are driven by a driving force transmitted via a drive chain 36 wound around chain sprockets 38 and 40. The chain sprocket 40 is driven by a driving means, such as a motor, through a conventional power train. The driving force transmitted via the drive chain 36 shifts the probe 10 into and out of the furnace on the base frame 20.

It should be appreciated that although the shown embodiment employs a chain drive system it would also be possible to employ one or more self-propelling carriers. In addition the intermediate carrier 34 supporting the central portion o the probe 10 can be replaced by a supporting bracket. Furthermore, a hydraulic cylinder can be used to drive the carrier. In this case, the hydraulic cylinder may be arranged to drive the carrier directly.

As is well known, a large amount of molten pig iron and molten drip through the portions of the furnace charged with coke, i.e. the areas other than the raceway or combustion region. Therefore, the probe 10, when inserted into this part of the furnace will be subject to very severe conditions which may cause the probe to be broken out or iron or slag particles to adhere to the surfaces of the probe. In order to establish a complete seal even under such conditions, the length of the seal pipe 18 is chosen to be longer than the length of the probe inserted into the furnace. This requires a longer probe and a carrier with increased travel. A combination of a hydraulic motor and a drive chain is preferred in the preferred embodiment of the combustion monitoring device to allow greater flexibility in the selection of the probe length and travel.

Figure 2:
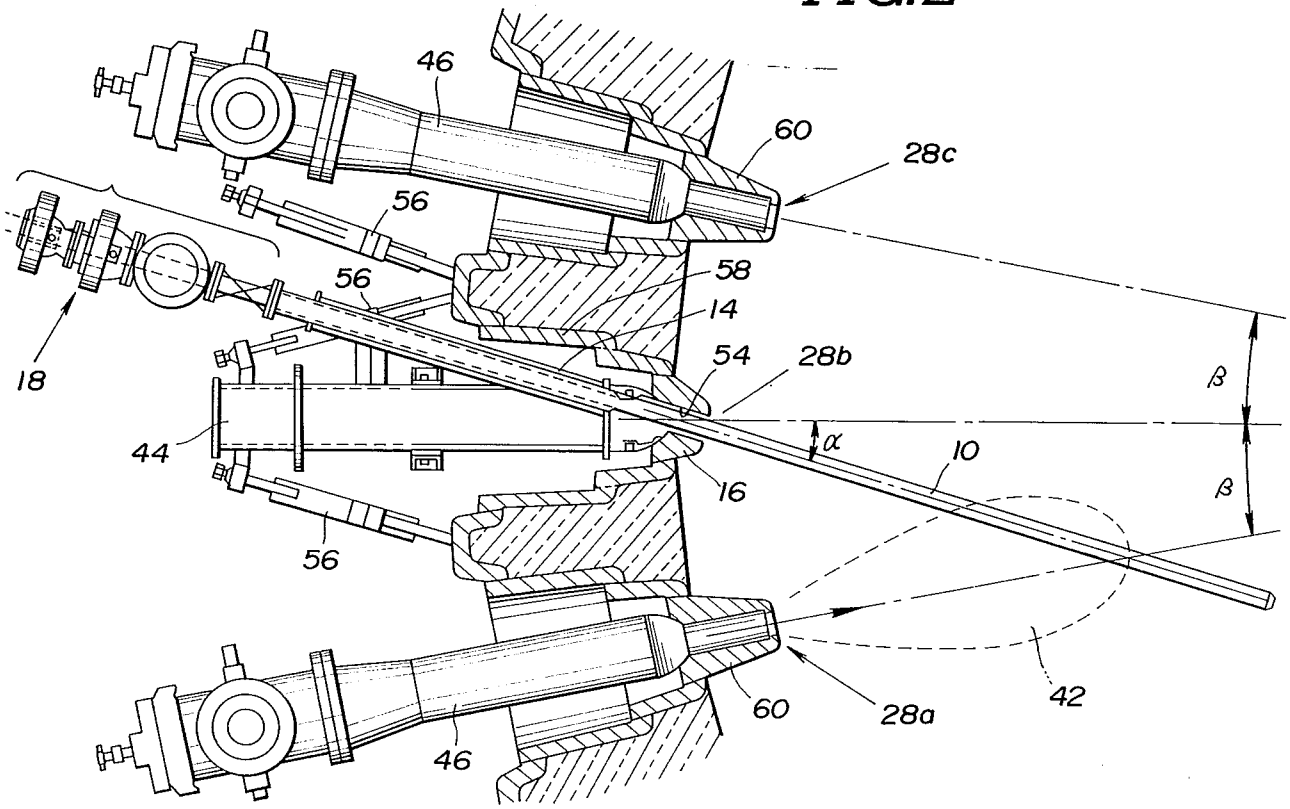
FIG. 2 is a top view of the major part of the preferred embodiment of the combustion monitoring device of FIG. 1.

FIG. 2 shows the probe 10 inserted into the furnace through the modified tuyere 16. FIG. 2 shows the preferred embodiment of the combustion monitoring device according to the invention as applied to a high-pressure shaft furnace with an internal volume of 3000 $m^3$. In this furnace, the tuyere assemblys 28*a*, 28*b* and 28*c* are spaced regular at angles $\beta$ of 11°15'. The raceway region 42 adjoins the tuyere assemblys 28*a* to a radial depth of about 1.3 m.

The probe 10 is inserted through the tuyere 28*b* to monitor combustion in the raceway region 42. The modified tuyere 16 mounted in front of the cooling box is specifically designed to accommodate the probe 10 and allowing it to be positioned oblique to the axis of a blow pipe 44 which is mounted in the modified tuyere 16. Blow pipes 46 are also mounted in the tuyere assemblys 28*a* and 28*c*. In the embodiment of FIG. 2, the blow pipe 46 mounted in the tuyere 28*a* injects high-temperature air into the furnace to induce combustion in the furnace and thus generates the raceway region 42 around the tuyere assembly 28a. Toward this end, the blow pipe 46 of the tuyere assembly 28a is connected to a branch pipe 48 of a circle main 50 which surrounds the furnace and circulates high-temperature air (see FIG. 1). The blow pipe 44 of the tuyere assembly 28b is usually connected to another branch pipe 48 so as to inject high-temperature air into the furnace for combustion, when it is in operation. However, to monitor combustion in the raceway region around the tuyere assembly 28a, the blow pipe 44 is disconnected from the branch pipe 48, in this embodiment. The branch pipe corresponding to the blow pipe 44 is closed by a closure plate 52 attached to its branch pipe.

The modified tuyere 16 mounted in the cooling box has a through opening 54 through which the probe 10 extends. The axis of the through opening 54 lies at an angle $\alpha$, e.g. 16°30′ to the axis of the blow pipe 44. The probe 10 extends along the axis of the through opening 54 and thus lies at the angle $\alpha$ to the axis of the blow pipe 44. The probe 10 is inserted into the furnace to a length of 3 m through the through opening 54 of the modified tuyere 16.

With this arrangement, the sleeve tube 14, the seal pipe 18 and the drive 12 are arranged along the axis of the probe 10 and thus lie about 16°30′ off the axis of the blow pipe 44.

It should be noted that the blow pipes 44 and 46 are secured to corresponding tuyere assemblys 28a, 28b and 28c by means of spring assemblies 56. In the shown embodiment, the blow pipe 44 serves as a retainer for the modified tuyere 16. The spring assemblies 56 retaining the blow pipe 44 have a spring force sufficient to resist the backward force exerted on the modified tuyere 16 when the probe 10 is drawn out of the furnace. The blow pipe 44, biased by the spring assemblies 56, pushes the modified tuyere 16 back toward the furnace and thus establishes gas-proof contact between the outer periphery of the modified tuyere 16 and the inner periphery of a cooling metal box 58.

The inner end of the modified tuyere 16 extends into the furnace to a length of 250 mm which is approximately half that of the normal tuyeres 60 designed for injecting high-temperature air into the furnace.

In the preferred embodiment, the diameter $\phi$ of the probe 10 is selected to be 80 mm in view of the need for resistance to heat and to buckling stress. The probe 10 is inserted into the furnace with a force of 13 tons. The diameter of the probe 10 may be adjusted according to the nature of the monitoring operation, the size of the furnace and so forth. Also, the force required to thrust the probe 10 into the furnace varies with the diameter of the probe 10. The relationship between the required force (P) and the diameter (D) of the probe can be expressed by the following equation:

$$P=\pi DL\sigma \tan \phi$$

$\sigma$ is the load-bearing stress of the burden (N/m$^2$)

tan $\phi$ is the coefficient of friction between the probe and charge, and

L is the depth of insertion of the probe (m).

The internal diameter of the modified tuyere 16 is chosen to be 130 mm, and on the other hand, the internal diameter of the sleeve tube 14 is chosen to be 100 mm, in order to accommodate the 80-mm probe 10. The blow pipe 44 is depressed toward the furnace with a total spring force of about 21 ton by the three spring assemblies 56 (only two of which are shown in the drawings).

The sleeve tube 14 is designed allow flow of cooling water therethrough for cooling. Similarly, the probe defines a cooling water path connected a cooling water source at its rear end in order to keep the probe cool by means of cooling water. The cooling water flow rate is related to the thermal load on the probe 10 within the furnace. The relationship between the thermal load and the required cooling water velocity can be seen in FIG. 3. Since thermal load is applied to the portion of the probe 10 inserted within the furnace in the shown embodiment, maximum 3 m of the probe 10 will subject the thermal load. Assuming a maximum thermal load in the furnace of $10\times10^6$ Kcal/m$^2$ hr, the required cooling water velocity would be about 8 m/sec.

Figure 3:
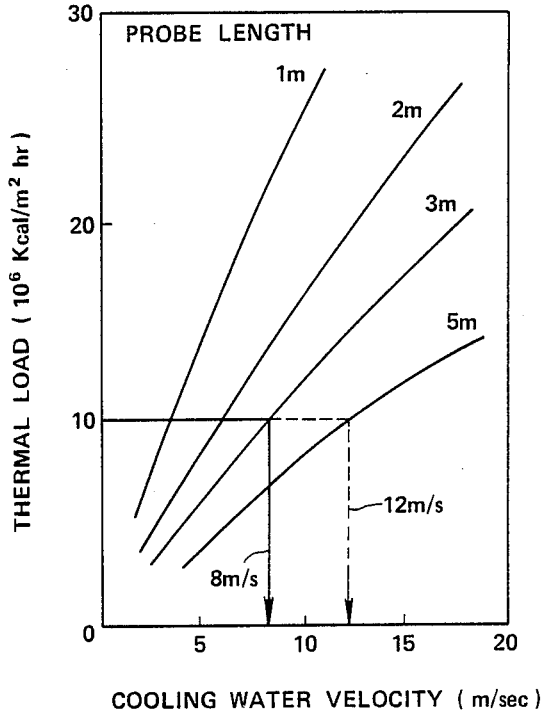
FIG. 3 is a graph of the relationship between thermal load on the probe of the monitoring device and the velocity of cooling water.

This can be compared with the required cooling water velocity in the conventional device discussed above. In the conventional device, the probe extends through the blow pipe through which high-temperature air flows. Therefore, assuming the probe is inserted into the furnace to a depth of 3 m and the length of the blow pipe is 2 m, the length of the portion of the probe subject the thermal load would be 5 m. As shown in FIG. 3, in this case the required cooling water velocity would be about 12 m/sec. Increasing the required velocity increases the pressure drop across the probe. Comparing the required cooling water velocity in the conventional device and with that in the inventive device reveals that the pressure drop in the conventional device is about 2.25 times greater than in the inventive device. Specifically, the empirical pressure drop in the inventive device was 10 kg/cm$^2$ and the required cooling water flow was 33 ton/hr. In comparison to this, the conventional device experienced a pressure drop of 22.5 kg/cm$^2$ and required 50 ton/hr of cooling water. This makes the conventional device impossible to implement, in practice.

Figure 4:
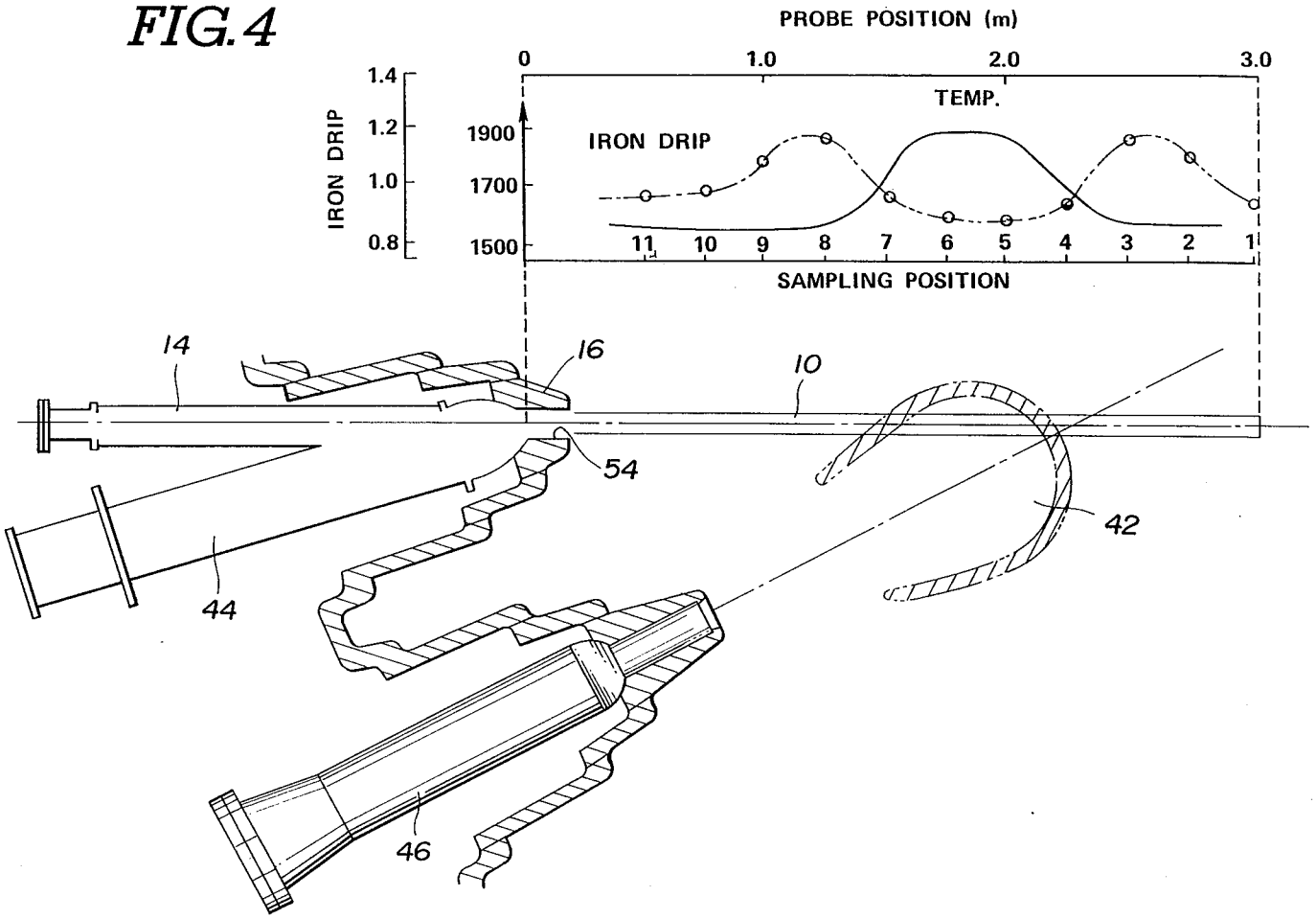
FIG. 4 is diagrammatically shows the effect of the preferred embodiment of the combustion monitoring device of FIGS. 1 and 2.

FIG. 4 shows the result of monitoring experiments on the shown combustion monitoring device according to the invention. In these experiments, the amount of dripping molten iron at various points and the temperature distribution across the furnace were monitored and plotted on the graph of FIG. 3.

An optical fiber and a two color pyrometer were used to measure the temperature distribution across the furnace. On the other hand, a melt sampler was used to sample the melt. The sampler was mounted at the end of a probe.

As will be clear from the results of these experimental measurements, the temperature in the furnace at points near the furnace wall and in the central portion of the furnace shows almost same values. On the other hand, the combustion region is much hotter. Relatively little molten iron drips through the combustion region. This is due to gas flow through the combustion region. On the other hand, the maximum rates of dripping molten iron and molten slag are observed at points surrounding the combustion region.

It should be appreciated that the angle subtended by the probe and a furnace radius leading to the tuyere assembly 28b is chosen to be 16°30′ in the shown embodiment in order to cover the combustion region and the central portion of the furnace simultaneously. However the inclination of the probe need not be limited to the disclosed specific angle.

Figure 5:
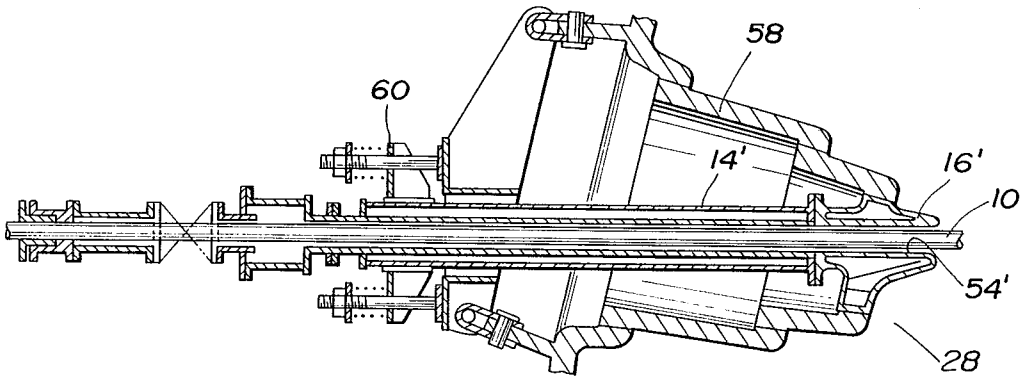
FIG. 5 is a section through a modification of a modified tuyere and the preferred embodiment of the combustion monitoring device of FIGS. 1 to 3.

FIG. 5 shows a modification to the preferred embodiment of the combustion monitoring device according to the present invention. In this modification, the modified tuyere 16' is held in front of the cooling box by means of the sleeve tube 14'. In order to hold the modified tuyere 16' in front of the cooling box, the sleeve tube 14' is integrally formed with a spring biased retainer 60.

The modified tuyere 16' itself is mounted in the cooling box 58 oblique to the radial axis of the furnace. In this case, the sleeve tube 14' serves to hold the axis of the through opening 54', and thus the probe 10, oblique to the radial axis at a given angle.

Figure 6:
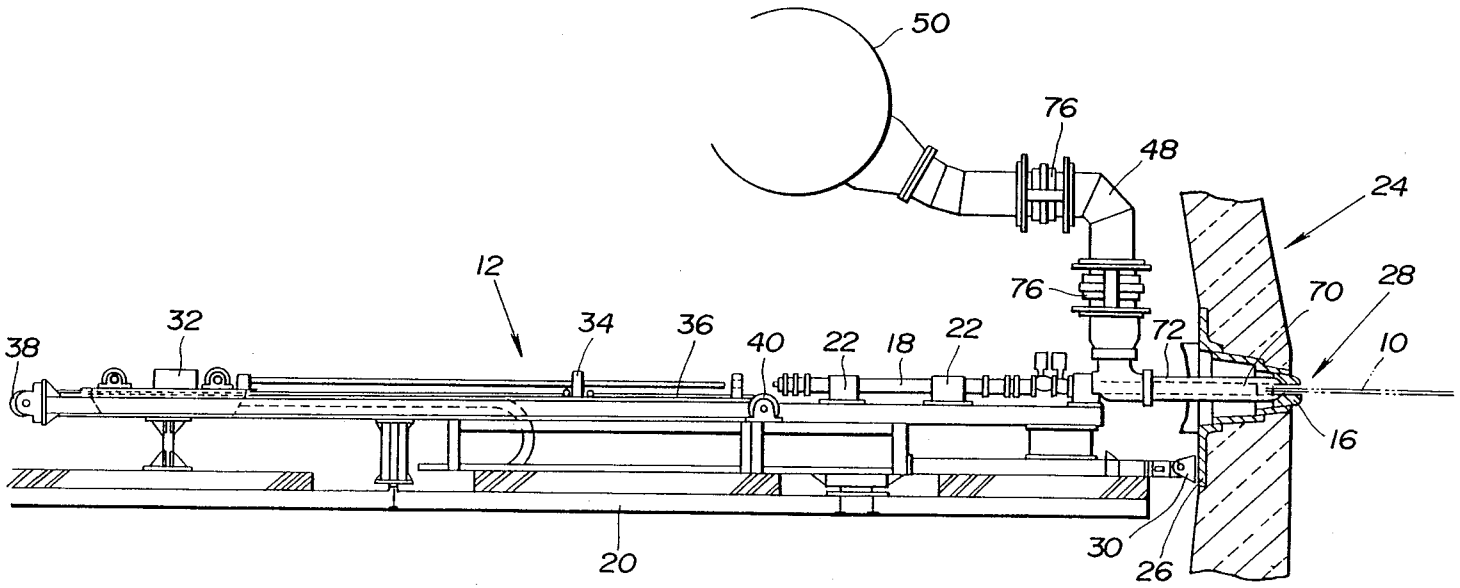
FIG. 6 is a side view of another embodiment of a combustion monitoring device according to the present invention.
Figure 7:
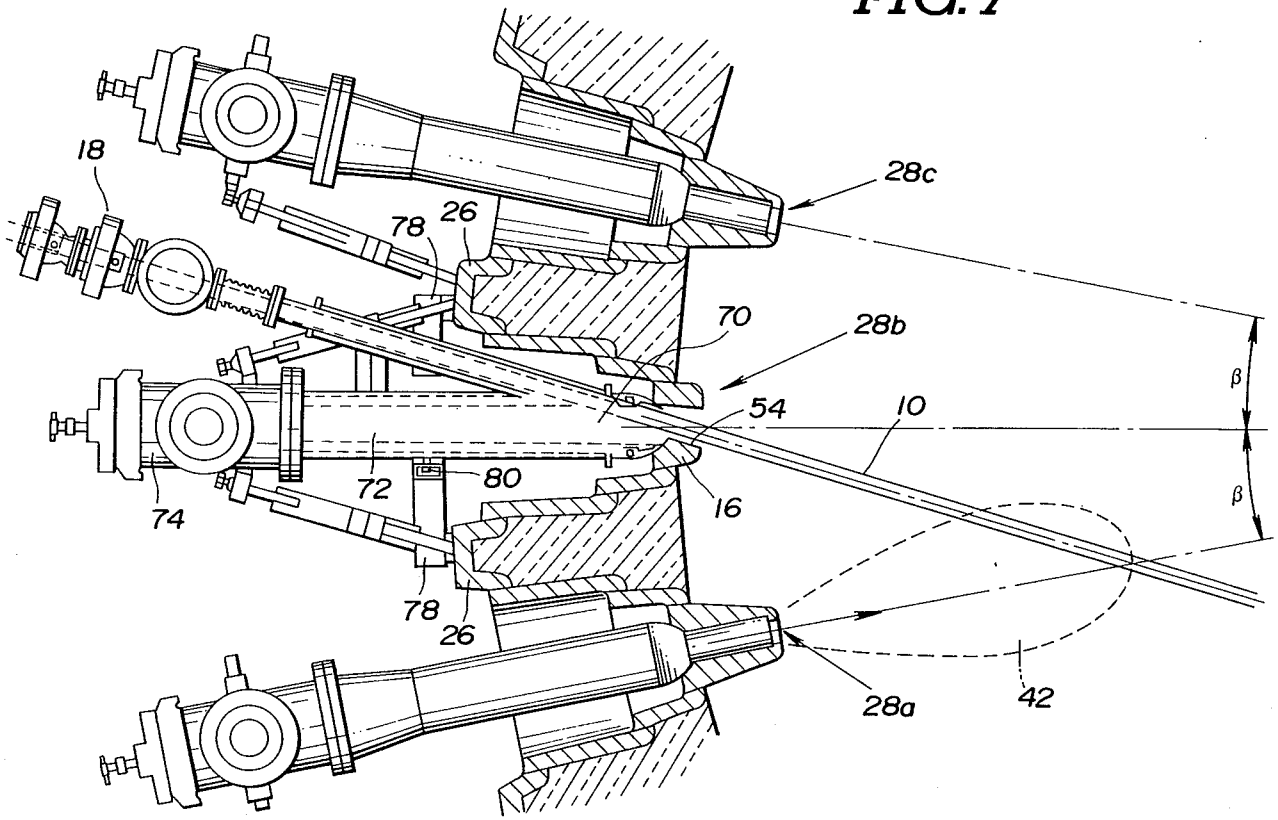
FIG. 7 is a view similar to FIG. 2 showing the major part of the combustion monitoring device of FIG. 6.
Figure 8:
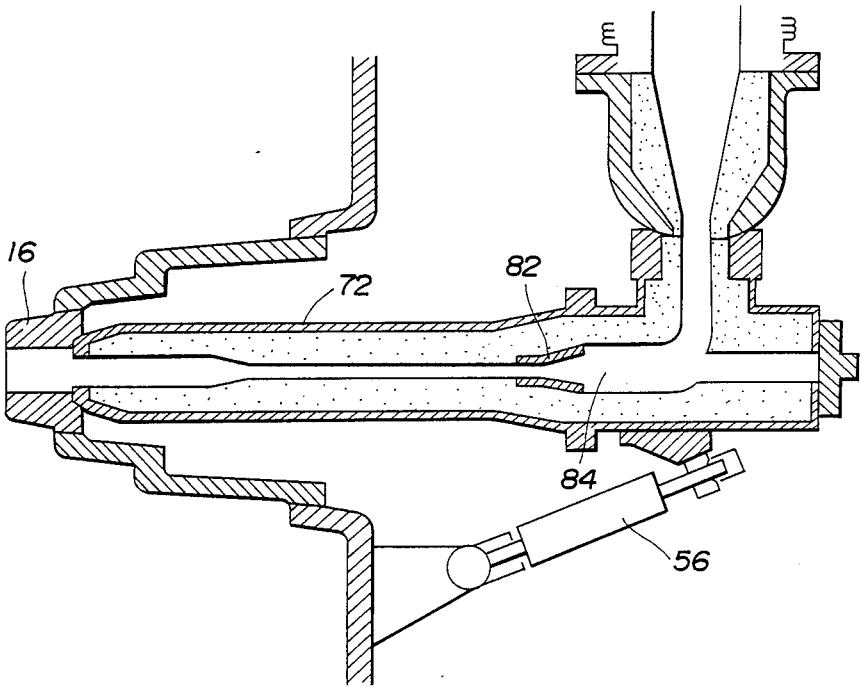
FIG. 8 is a section through a heated air injector employed in another embodiment of the combustion monitoring device of FIG. 6.

FIGS. 6 to 8 show another embodiment of a combustion monitoring device according to the present invention. In the following disclosure for another embodiment of the combustion monitoring device, components matching those employed in the foregoing preferred embodiment of FIGS. 1 to 5 will be represented by the same reference numerals and not described in detail so as to simplify the disclosure and to avoid redundant recitation.

In this embodiment, a blow pipe 72 is modified from that shown in the former embodiment, so that it may be connected to a branch pipe 48 for communication therebetween. Furthermore, as disclosed with reference to FIG. 5, the blow pipe 72 is associated with a retainer 74 which is biased toward the furnace by the spring assemblies 56. The retainer 74 has a passage communicating with the interior of the blow pipe 72 in order to conduct hot or cool air therethrough.

The blow pipe 72 is connected to the circle main 50 through the branch pipe 48 in the same manner as that for other blow pipes which introduce the high-temperature air into the furnace to induce combustion. The continuous air flow i.e. either hot air flow or cool air flow, avoids the necessity of closing the disconnected branch pipe which is required in the previous embodiment and to prevent melt from flowing into the tuyere. In order to prevent melt from flowing into the tuyere, an air flow sufficient to move coke away from the tuyere will blow through the blow pipe 72. In the case of a tuyere approximately 120 mm in diameter, the air flow rate through the blow pipe 72 may be about 15 $Nm^3$/min.

In cases where the hot air is utilized, some displacement tends to occur between the blow pipe and the branch pipe 48 tends to occur due to thermal expansion. In order to correct for this, expansion joints 76 are used in the branch pipe 48. On the other hand, in order to suppress displacement of the blow pipe 72 relative to the axis of the retainer 74, stopper members 78 are employed. The stopper members 78 are fixed to the metal frame 26 of the furnace at one end and support contact bolts 80 at the other end. The contact bolts 80 establish point-contact with the outer periphery of the blow pipe 72 so as to allow axial displacement of the blow piipe 72 while preventing radial displacement.

Figure 9:
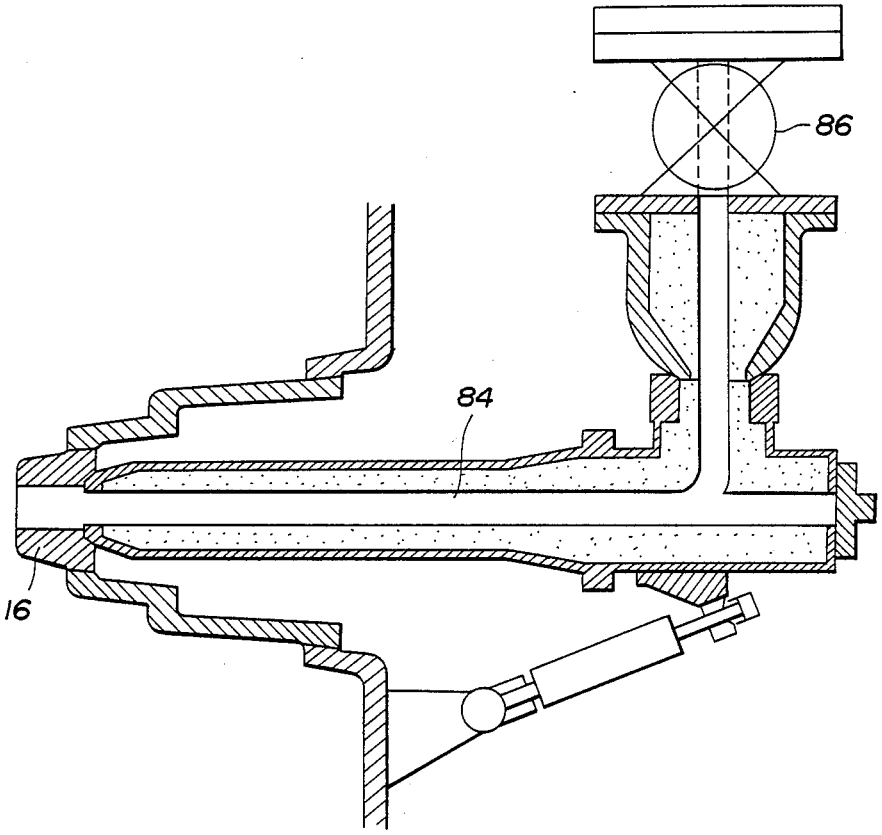
FIG. 9 is a section through a modified heated air injector.

FIG. 8 shows the blow pipe employed in this embodiment in greater detail. In the embodiment of FIG. 8, a flow control ring 82 is disposed within the air flow path 84 within the blow pipe 72. The flow control ring 82 limits the air flow cross-section and thereby controls air flow into the furnace. Alternatively, control of the air flow through the blow pipe can be performed by means of a flow control valve 86 as shown in FIG. 9. The flow control valve 86 may be made of ceramic in view of the relatively high temperatures to which the valve will be subjected.

With this construction, when combustion monitoring is not necessary, the probe 10 is retracted into the sleeve tube 70. Thereafter, the blow pipe 70 can serve as a normal blow pipe inducing combustion near the corresponding tuyere. In this case, heated air flow amount should be increased to a sufficient level. Preferably, the tuyere is shifted so as to blow the heated air slightly further downward than when being used for the probe in order to avoid overlap of combustion regions.

As will be appreciated herefrom, the present invention enables efficient and accurate measurement or monitoring of combustion in the furnace.

Although the foregoing disclosure of experimental measurement has been directed to measurement of temperature in the furnace and sampling of the melt, various kinds of information can be obtained by means of the monitoring device according to the invention. For example, the distribution of slag composition, the distribution of the pig iron composition across the furnace and so on can be measured with the aid of the monitoring device described above.

What is claimed is:

1. A device for monitoring combustion in a furnace comprising:

a tuyere mounted in a tuyere assembly of said furnace and defining a through opening extending oblique to a radius of said furnace extending through the center of said tuyere, a combustion region being formed around said tuyere, a probe extending through said through opening into the interior of said furnace, guide means arranged in such a manner that the axis of said probe extending across the combustion region formed around said tuyere is oblique to the radial axis of the furnace for monitoring combustion in said furnace; and a drive mechanism for thrusting said probe at said oblique angle into and retracting said probe from said furnace.

2. A combustion monitoring device as set forth in claim 1, wherein the obliquity of said through opening in said tuyere allows said probe to extend across a combustion region formed about an adjoining tuyere.

3. A combustion monitoring device as set forth in claim 2, wherein said drive mechanism includes a support and means for supplying cooling water for cooling said probe.

4. A combustion monitoring device as set forth in claim 3, wherein said support comprises a sleeve tube defining therein a cooling water path and allowing said probe to pass therethrough axially, and a seal pipe sealingly supporting said probe.

5. A combustion monitoring device as set forth in claim 3, which further comprises a retainer for detachably securing said tuyere onto the tuyere assembly.

6. A combustion monitoring device as set forth in claim 4, wherein said sleeve tube is in communication with a blow pipe through which air is conducted at a given velocity so as to discharge air into said furnace through said tuyere.

7. A combustion monitoring device as set forth in claim 6, wherein said blow pipe is associated with means for restricting displacement of said blow pipe in a direction perpendicular to its axis while permitting axial displacement thereof.

8. A combustion monitoring device as set forth in claim 7, wherein said blow pipe is connected to an air source via an air pipe which includes a section allowing axial displacement of said blow pipe.

9. A combustion monitoring device as set forth in claim 1, wherein said drive mechanism includes a support for said probe which includes means for cooling said probe, said support comprising a sleeve tube defining therein a cooling water path and allowing said probe to pass therethrough axially, and a seal pipe sealingly supporting said probe.

10. A combustion monitoring device as set forth in claim 9, wherein said support comprises a sleeve tube defining therein a cooling water path and allowing said probe to pass therethrough axially, and a seal pipe sealingly supporting said probe.

11. A combustion monitoring device as set forth in claim 9, which further comprises a retainer for detachably securing said tuyere onto the tuyere assembly.

12. A method for monitoring combustion in a metallurgical furnace comprising the steps of:

defining a passage way for a probe in one tuyere, the axis of which passage way lies oblique to a radius of said furnace passing through said tuyere and extends to a combustion region formed near and adjoining tuyere;

thrustingly inserting said probe through said passage way and across said combustion region toward a central region of said furnace for combustion monitoring.

13. A method as set forth in claim 12, which further comprises a step of cooling said probe during insertion and retraction of said probe into and from said furnace.

14. A method as set forth in claim 13, which further comprises a step of blowing air into said furnace through said passage way.

15. A method as set forth in claim 14, wherein the air flow into said furnace is sufficient to prevent molten material from leaking out through said tuyere.

16. A device for monitoring combustion in a furnace which has a furnace wall provided with a plurality of tuyeres arranged in circumferential alignment with a given essentially regular angular interval, combustion regions being formed around respective tuyeres, comprising:

a tuyere fixture mounted in a first tuyere of said furnace and defining a through opening extending at an oblique angle to the radius of said furnace extending through the center of said tuyere at a predetermined oblique angle which is so selected as to lie at an angle to the extension of the axis of said through opening across one of said combustion regions formed around a second tuyere oriented next to said first tuyere;

a probe inserted into the interior of said furnace through said through opening of said first tuyere and extending along said axis of said through opening at an oblique angle to the furnace radius; and a drive mechanism constructed and arranged for thrustingly driving said probe at said oblique angle so that said probe may reciprocally move across said combustion region established around said second tuyere.

* * * * *